US010179276B2

(12) United States Patent
Vaughan

(10) Patent No.: US 10,179,276 B2
(45) Date of Patent: Jan. 15, 2019

(54) INTERNATIONAL SOCCER BOARD GAME

(71) Applicant: Patrick A. Vaughan, Queens Village, NY (US)

(72) Inventor: Patrick A. Vaughan, Queens Village, NY (US)

( * ) Notice: Subject to any disclaimer, the term of this patent is extended or adjusted under 35 U.S.C. 154(b) by 0 days.

(21) Appl. No.: 15/073,814

(22) Filed: Mar. 18, 2016

(65) Prior Publication Data

US 2017/0266539 A1 Sep. 21, 2017

(51) Int. Cl.
*A63F 7/06* (2006.01)
*A63F 3/00* (2006.01)

(52) U.S. Cl.
CPC ..... *A63F 7/0668* (2013.01); *A63F 7/0616* (2013.01); *A63F 2003/0046* (2013.01); *A63F 2003/00233* (2013.01); *A63F 2250/645* (2013.01)

(58) Field of Classification Search
CPC ..... A63B 69/00; A63F 3/00
USPC ..... 273/108.1, 108.5, 244, 259
See application file for complete search history.

(56) References Cited

U.S. PATENT DOCUMENTS 2,828,964 A * 4/1958 Horton ..... A63F 7/0668 124/16
3,784,200 A * 1/1974 Hotchkiss ..... A63F 9/02 273/353
4,408,761 A * 10/1983 McAllister ..... A63F 7/40 273/108.5
5,431,397 A * 7/1995 Eckel ..... A63F 7/0668 273/108.1
5,662,331 A * 9/1997 Cucci ..... A63B 67/06 206/315.1
5,901,956 A * 5/1999 Warmack ..... A63F 3/00041 273/244
8,216,091 B2 * 7/2012 Neal ..... A63B 43/002 473/422

* cited by examiner

*Primary Examiner* — Gene Kim
*Assistant Examiner* — Christopher Glenn
(74) *Attorney, Agent, or Firm* — Dunlap Bennett & Ludwig PLLC; Brendan E. Squire

(57) ABSTRACT

A soccer board game to emulate the action, skill and strategy of a conventional soccer match. The board game includes a game board having markings of a conventional soccer pitch. Cylindrical player pieces are utilized to manipulate a ball piece and impart a sliding or a flipping motion in the ball piece. The players may pass, shoot, or throw the ball in actions to emulate the play of a conventional soccer match.

20 Claims, 4 Drawing Sheets

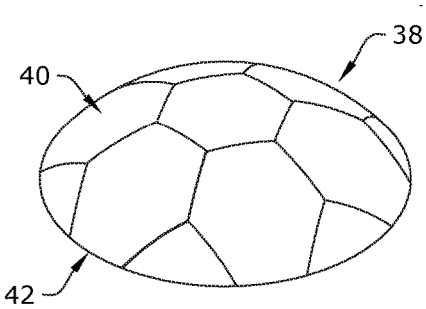
FIG.9
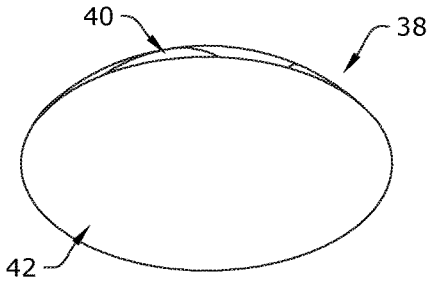
FIG.10
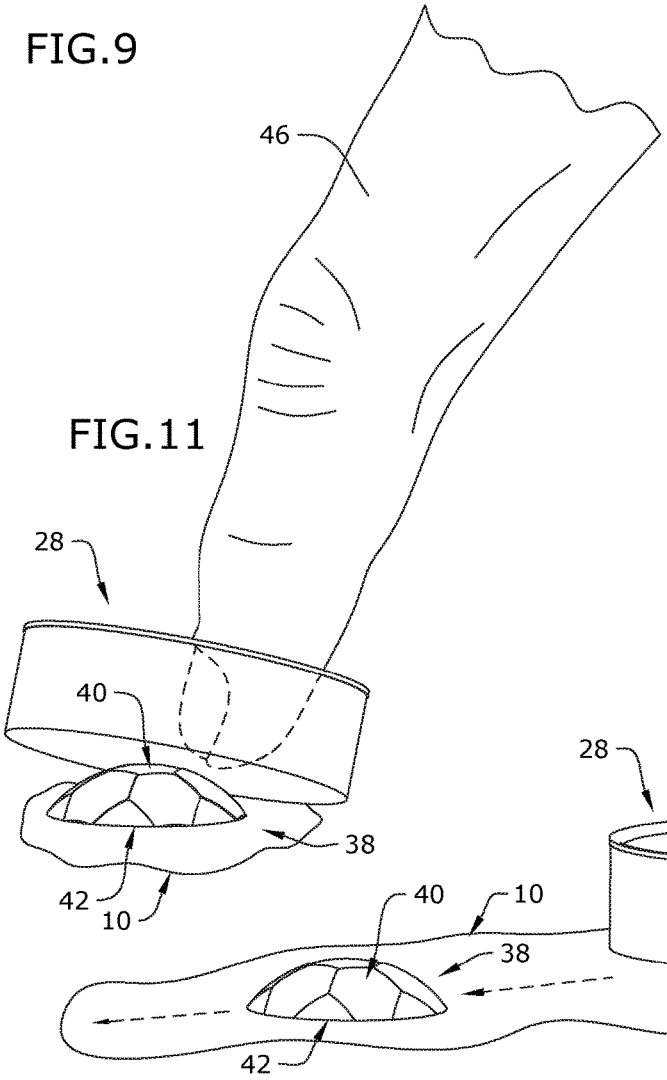
FIG.11
FIG.12

INTERNATIONAL SOCCER BOARD GAME

BACKGROUND OF THE INVENTION

The present invention relates to board games, and more particularly, to board games for playing futbol/soccer.

Currently in the art of board games, and games for soccer that rely on the user rolling one or more dice or drawing one or more cards in order to play a game. These aspects make the games rely on chance, and do not instill much strategy to the game. Similarly, these games do not provide much of a skill challenge or action for the players of the game. Consequently, after playing the games a short while, the players may lose interest and abandon playing the games in the future.

As can be seen, there is a need for a soccer board game that imparts elements of strategy, player skill, and action to provide an exciting and engaging game.

SUMMARY OF THE INVENTION

In one aspect of the present invention, a board game is disclosed and claimed which includes: a game board having a substantially rectangular surface having indicia representing a marking of a soccer field; a plurality of first team player pieces having a first color; a plurality of second team player pieces having a second color; wherein the first team player pieces and the second team player pieces are formed having a substantially cylindrical hollow body with a closed bottom end surface and an open top end; a goal net; and a ball piece formed as a spherical section having a substantially flat bottom surface and a curved top surface. The board game wherein at least one of the plurality of first team player pieces and at least one of the plurality of second team player pieces includes goalie (or keeper/goal keeper) team piece (or player piece). The goalie team piece may have a base portion extending from a lateral side surface of the substantially cylindrical hollow body. The base portion is adapted to position the goalie team piece in a substantially vertical orientation such that the closed bottom end surface is oriented substantially perpendicular to a playing surface of the substantially rectangular game board.

In certain embodiments, the plurality of first team player pieces and the plurality of second team player pieces may include an insert received within the substantially cylindrical hollow body. The insert may have at least one surface carrying indicia representing a soccer team. The first and second player pieces may also include a clear insert cover adapted to be received within the substantially cylindrical hollow body. The game board may include a frictional surface and may also be substantially rigid. The game board may also be foldable. In other embodiments of the invention, the top surface of the ball piece may also include an interlocking pattern of hexagonal portions.

In other aspects of the invention, a method of board game play, may include: providing a game board having a substantially rectangular surface with indicia representing a marking of a soccer field; providing a player piece formed having a substantially cylindrical hollow body, a closed bottom end surface and an open top end; providing a ball piece formed as a spherical section having a substantially flat bottom surface and a curved top surface; positioning the closed bottom end surface against a portion of the ball piece; and applying pressure to the player piece to impart a movement of the ball piece. In some forms the method may include positioning the flat bottom surface of the ball piece in contact with the game board. In other forms, the method may include positioning the curved top surface of the ball in contact with the game board. The method may also include providing a frictional surface to the substantially rectangular surface.

These and other features, aspects and advantages of the present invention will become better understood with reference to the following drawings, description and claims.

BRIEF DESCRIPTION OF THE DRAWINGS

FIG. 9 is a top perspective view of ball play piece.

FIG. 10 is a bottom perspective view of the ball play piece.

FIG. 11 is a side perspective view demonstrating a user operation of the player piece with the ball play.

FIG. 12 is a side perspective view demonstrating the ball movement after manipulation by the player piece.

DETAILED DESCRIPTION OF THE INVENTION

The following detailed description is of the best currently contemplated modes of carrying out exemplary embodiments of the invention. The description is not to be taken in a limiting sense, but is made merely for the purpose of illustrating the general principles of the invention, since the scope of the invention is best defined by the appended claims.

Broadly, an embodiment of the present invention provides a game board and player pieces for playing a dynamic, strategy and skill oriented game for playing soccer.

Figure 1:
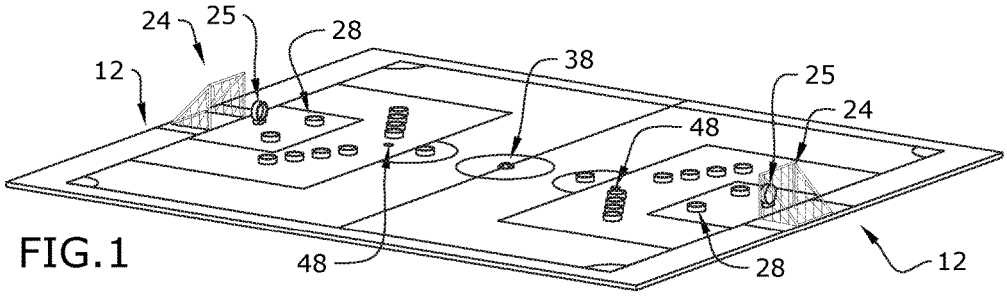
FIG. 1 is a perspective view of a game board and player pieces according to aspects of the invention.
Figure 8:
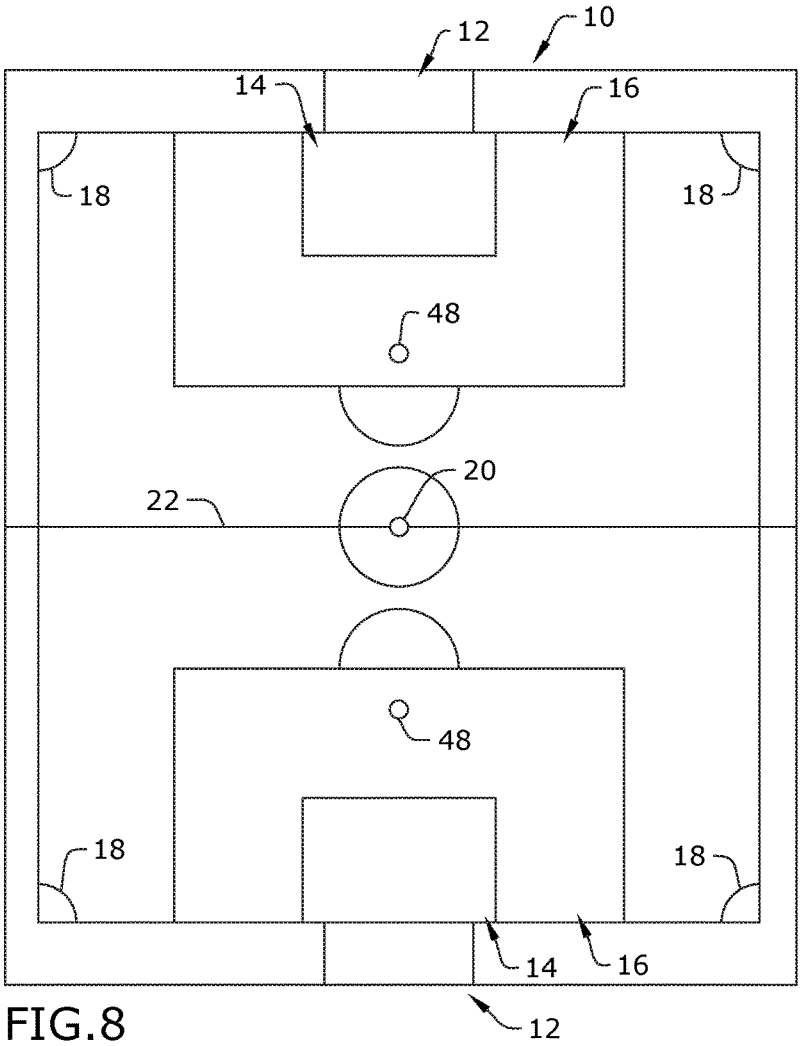
FIG. 8 is a top view of the game board.

As seen in reference to FIGS. 1 and 8, an embodiment of a soccer game board 10 and play pieces 28, 25 is shown. As seen in FIG. 8, the game board 10 may be a foldable board that opens to allow the user to set up the board for play. The game board 10 is marked with conventional futbol/soccer field markings disposed on a substantially rectangular field of play, represented by the game board 10. The game board 10 may include a fabric surface or a frictional surface texture. The board may be between about 32 inches and 48 inches in length and between about 16 inches and 24 inches in width. Preferably the board 10 is between about 34¼ inches long and 17¼ inches wide. The game board 10 includes a goal net placement area 12. The markings include a center mark 20, and a center line 22, a penalty area 16, a goal area 14, corner markings 18, and a penalty spot 48.

Referring back to FIG. 1, a goal net 24 is placed in each of the respective goal net placement regions 12 on the game board 10. The goal net is dimensioned to correspond with the size of the game board 10 and a regulation scale goal net 24. For example, the goal net may be about 3 inches wide and 2¼ inches in height. A goalie player piece 25 is positioned within the respective goal areas 14 to set up for play. Two or more game participants or players may array their respective player pieces 48 on the game board 10. A ball game piece 38 is positioned on the center mark 20. The player pieces 48 and goalie player pieces 25 may be colored to permit the game participants to distinguish between the associated teams corresponding to game play pieces 25, 48.

Figure 2:
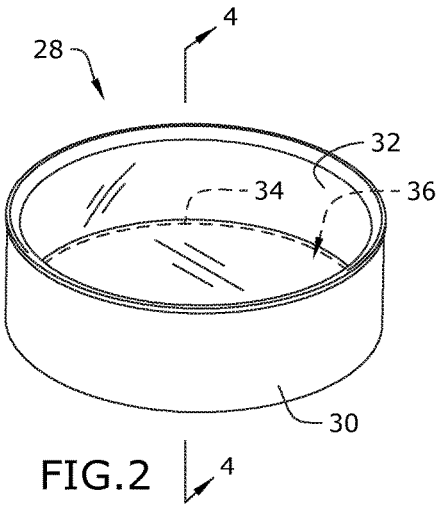
FIG. 2 is a perspective view of a player piece body according to aspects of the invention.
Figure 3:
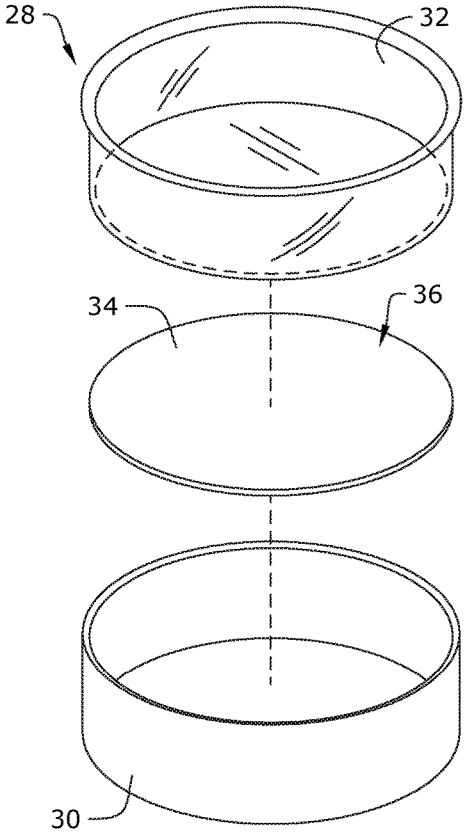
FIG. 3 is an exploded view of a player piece.
Figure 4:
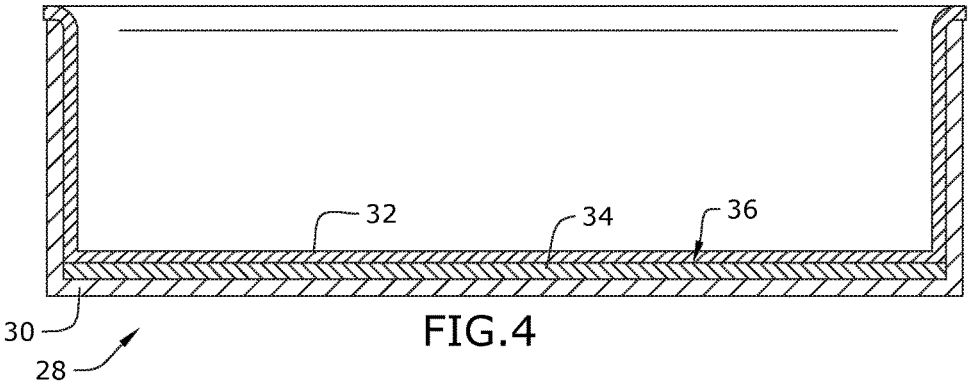
FIG. 4 is a section view of a player along line 4-4 in FIG. 2.

As seen in reference to FIGS. 2-4, an embodiment of a player game piece 28 is shown. The player game piece 28 is formed a substantially cylindrical shaped hollow body 30 having a closed bottom surface 44. An insert 32 and body 30 may be colored such that they may carry the colors of a popular soccer team. A surface 36 of the insert may also include emblems or other indicia of a popular soccer team. The player game piece 28 may be formed in any suitable size for manipulation by a player's finger. In a preferred embodiment, the player piece may have a diameter of about 1⅛ inches, a width of about ⅜ inches, an inside diameter of ⅞ inches.

A game set may include inserts 32 sorted with which ever flag jersey is desired. A clear cover piece 32 may be inserted within the body 30 to secure flag jerseys insert 32 within the player game piece 28. The cover piece 32 will also protect the insert 32 from marring, damage, or wear during play.

Figure 5:
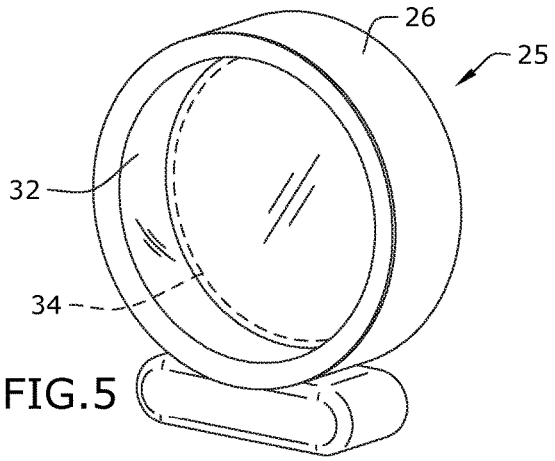
FIG. 5 is a perspective view of a goalie play piece.
Figure 6:
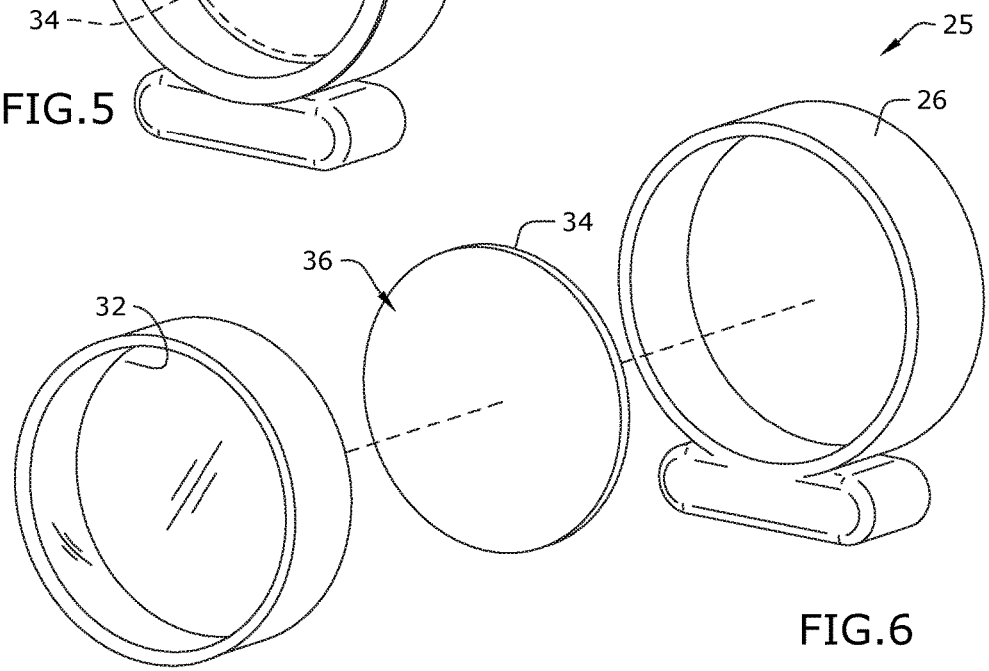
FIG. 6 is an exploded view of the goalie play piece and insert.
Figure 7:
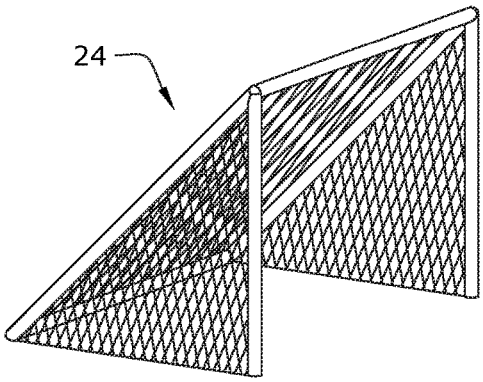
FIG. 7 is a perspective view of a goal.

As seen in reference to FIGS. 5 & 6, a goalkeeper game piece 25 is illustrated. The goal keeper game piece 25 is formed in substantially the same manner as the player game piece 28. The goal keeper 25 has a substantially cylindrical body 26, an insert disk 34 having a display surface 36, which may be covered by a clear cover piece or cap 32. However, the goal keeper game piece is formed with a base member extending from a lateral sidewall of the cylindrical body 26 to support the goalkeeper 25 in a vertical orientation, with the face of the piece oriented substantially perpendicular to the playing surface of the game board 10. The base member may have a length of about ½ inch and a width of about ¼ inch.

As seen in reference to FIGS. 9 and 10, a soccer ball game piece 38 has a top surface 40 that is formed as generally spherical section, more preferably having a hexagonal patterned surface resembling a surface of a conventional soccer ball. The soccer ball game piece 38 will also have a substantially flat bottom surface 42. The ball 36 may be suitably sized to correspond with the player pieces 25, 28. In a preferred embodiment, it may be about ⅛ inch in height and have a diameter of about ½ inches.

As seen in reference to FIGS. 11 and 12, the player game pieces 28 and goalie game piece 25 are manipulated by the game participants to impart movement in the soccer ball piece 38 for the purpose of passing, kicking, or otherwise directing the soccer ball piece 38 on the playing surface of the game board 10 during game play.

To impart movement in the ball 38, a player may place the bottom surface 44 of the player piece 28 in contact with the upper surface 40 of the soccer ball 40. The player may then apply a force to the inner bottom surface of the player piece 28, 25 with a finger 46. As the force is applied downwards with the finger 46, ball game piece will be projected outwardly from beneath the bottom surface 44 of the player piece. With the bottom surface 42 of the soccer ball 38 oriented in contact with the playing surface 10, the soccer ball 38 will slide along the playing surface 10. The direction and rate of travel are influenced by the positioning of the player piece 28 on the soccer ball 40 as well as the rate, direction and amount of force applied by the player's finger 46. As indicated the soccer ball 38 is designed with a flat surface 42 for keeping the ball 40 on the play board 10 when passing or taking a shot at goal.

Alternatively, the player in possession of the ball 38 may invert the ball 38 so that the spherical surface 40 is in contact with the playing board surface 10. In this case, the spherical surface 40 is used for in air passing of the ball 38 or shot to goal 24. The player would place the bottom surface 44 of the player piece 28 in contact with the flat surface 42 of the ball 38, and apply a force to the player piece 28. In this case, the movement imparted to the ball 38 will flip the ball 38 into the air, thus providing the participants emulation of the attributes of a real life soccer match.

For example, to make a shot to the goal 24, a shooting player would say the word "set". The opponent player would then have the opportunity to position his/her player pieces (or team piece) 28 and goal keeper 25 to block the shot on the goal 24. If the shooter scores a goal, the shooting player is awarded a point, and play would be set up from the half line mark 22 is possession awarded to the opponent team. Game play would proceed according to conventional soccer rules, or the players may opt for variations of the rules according to their situation in the game play.

Some example game play rules to adapt the game board constraints to emulate a soccer match may include one or more of the following:

SCORING—Players make a goal shot by first saying "Set". This allows the other player to set their "GOAL NET" and their "KEEPER" before the opposing player makes their shot.

BUMBALL—When the ball ends up between two opposing team player pieces 28 creates a conflict as to who has possession, simply pick the ball 38 up and drop it in the middle of the conflicting player pieces 28. The player whose team piece 28 is closest to where the ball 38 comes to rest gets possession of the ball 38. ("BUMBALL" could be repeated for resolution)

TOUCHES—When a player's team piece 28 touches the ball more than three times without passing to another team piece 28, possession of the ball 38 goes to the closest team piece of opposing team.

OFFSIDE—If a first team piece 28 is placed on the game board 10 past an opposing team piece last defender before a goal keeper 25 and the ball 38 is passed to that team piece 28, it's an "OFFSIDE" award the ball 38 for a goal kick to player that calls "OFFSIDE".

FOUL—a foul play is given when a team piece 28 touches an opposing team piece 28. Possession of the ball 38 is given to the team piece 28 that was fouled by the opposing team piece 28 for direct or indirect free kick.

HANDS—If the ball lands inside a team piece 28, possession of the ball 38 is awarded to the closest opposing team piece for direct or indirect free kick.

DIRECT FREE KICK—If a "FOUL or HANDS" by an opposing team piece 28 in the opposing team's half of the play surface 10 towards the defending goal keeper 25 then a "DIRECT FREE KICK" towards the opposing team's goal 24 is awarded to the team in possession of the ball 38. (To make play from Foul or Hands opposing team piece 28 has to be one team piece 28 away to allow play)

INDIRECT FREE KICK—If a "FOUL or HANDS" by opposing team piece 28 in the defending half of the field toward the opposing team goal keeper 25 then "INDIRECT FREE KICK" to pass the ball 38 is awarded. (To make play from Foul or Hands opposing team piece has to be one team piece away to allow play)

CORNER KICK—If the ball 38 is moved past an defensive goal line by a defending team piece 28 in its defending half of the field, then a "CORNER KICK" is awarded to the offensive team. (To make play, defending team piece has to be at least one team piece away to allow play)

FREE THROW—If the ball 38 goes off the board 10 from a side line by a team piece then a "FREE THROW" is awarded to the opposing team piece 28. A "FREE THROW" is made by turning team piece over 28 and placing the ball 38 on top and pushing the team piece to allow ball to free fall from team piece at the side line. Turn the team piece 28 making the play over and continue playing. If the ball 38 did not fall off, then it is a "HANDS" and the ball possession goes to the opposing team piece 28.

GOAL—This is one point given to a team for scoring by shooting the ball 38 into the goal net 24. Each time there is a goal scored; both players move their team pieces 28 back to their starting position before play resumes.

GOAL KEEPER ALLOWANCE—The Goal Keeper 25 is not allowed to move beyond penalty box 16 unless passing or throwing out a ball 38. If caught beyond penalty box and "SET" is asked by opponent only the goalie 25 can be placed.

PENALTY—If a "FOUL or HANDS" by opposing team piece occurs in their penalty area 16 then a "PENALTY" is awarded. A "PENALTY" shot is taken from the penalty spot 48 in goal area with the goal keeper 25 positioned on the goal line and team piece 28 awarded attempts the shot on goal.

PENALTY SHOOT OUT—If there is no goal score during the previously agreed game time, OR if there is a tie-score by the end of game time, a "PENALTY SHOOT OUT" may be played. Each player choose one team piece 28 along with His/Her "Goal Keeper" 25. Player 1 goes first with three tries to make goal score against the opposing team goal keeper 25. Player 2 goes after, according to the same. The player with the most goals scored in the shootout wins. If the score ties, continue playing the "PENALTY SHOOT OUT" until a winner is determined.

Game Play

The object of the game is to score the most goals/points in a pre-agreed time, such as 10, 20, or 30 minutes. Game play may be conducted according to the following steps:

Determine and agree on a length of game time.

Decide who has initial possession of the ball, which can be determined by age, height, coin toss, etc.

Whoever has possession first should place 2 team pieces 28 on the center line 22 of the field with the ball 38 at the center mark 20 in center circle and with remaining team pieces 28 in their (defending) half on field.

The opposing team pieces 28 may be placed by the opponent and must stay out the center circle and be positioned in their (defending) half on the field.

The team in possession passes the ball 38 by placing team piece 28 at the edge of ball 38 and press down for it to move.

During play each team piece 28 can touch the ball three times with a pass or shot to goal included.

After the ball 38 is passed the team piece 28 that is closest to the ball 38 claims possession.

A player can only move a team piece 28 into any chosen position after the player with possession moves a team piece 28. (If player chooses not to move, opponent is without a play.)

Take turns until someone scores.

A player must say "SET" in order to take a shot on goal and for a goal to count as a score. In response to the "SET", the opponent to set their Goal keeper 25 into position within the penalty area 16, before making the goal shot.

The player who was scored against, gets ball 38 possession and the players return back to the start position, with the spotting of the ball 38 on center line 22 in center circle 20.

If no goal is scored in a suggested time, or if there is a tie-score, you have the option to add more time, or go to "Penalty Shoot Out".

Game Play Variations may be played according to some of the following supplemental rules SIX A SIDE—Instead of 10 team pieces and a goal keeper you use 5 team pieces and a goal keeper to play the game.

PENALTY SHOOT OUT—Each player choose one of their team piece and goalie/keeper. The amount of shot that can be taken is up to the players. Player 1 goes first with a previous agreed number of shots to goal, while player 2 sets their goalie/keeper on the goal line to prevent a goal score. Each player has the same amount of penalty shots. The player with the most goal score wins the game.

HALF LINE SHOOT OUT—Each player chooses one team piece and their goalie/keeper. The amount of shot that can be taken is up to the players. Player 1 goes first with a previous agreed number of shots to goal from the spot point on the half line in the center circle, while player 2 sets their goalie/keeper on the goal line to prevent a goal score. Each player has the same amount of penalty shots. The player with the most goal score wins the game.

A game set according to the present invention may include: 28 clear cover pieces; 12 Player Team Pieces in a first color; 12 Player Pieces in a second color; 2 first color Goal Keepers; 2 second color goal keepers; 3 soccer ball pieces; 2 Goal Nets; 1 Score Sheet; 1 Miniature Soccer Field game board; and 4 sets of interchangeable team jersey inserts The game board 10, player pieces 25, 28, and soccer ball 38 of the present invention provides a dynamic, action, strategy, and skill based game for simulating play of a soccer match. In particular it fulfills the need of people that may be physically challenged and unable to participate in an actual soccer match, but wants to enjoy a good soccer game. Besides having a new game, the game set of the present invention can also be used by a coach to demonstrate game plans for a real soccer game in its most realistic form.

It should be understood, of course, that the foregoing relates to exemplary embodiments of the invention and that modifications may be made without departing from the spirit and scope of the invention as set forth in the following claims.

What is claimed is:

1. A board game, comprising:

a game board having a substantially rectangular surface having indicia representing a marking of a soccer field;

a plurality of first team player pieces having a first color;

a plurality of second team player pieces having a second color;

the first team player pieces and the second team player pieces formed having a substantially cylindrical hollow body with a closed bottom end surface disposed for contact with the game board surface during play and an open top end with the cylindrical hollow body dimensioned to receive a finger of a player;

a goal net;

a ball piece formed as a spherical section having a substantially flat bottom surface and a curved top surface, and wherein, with the ball piece positioned subjacent to the closed bottom end surface, a movement is imparted to the ball piece by application of a downward pressure by the player's finger within the cylindrical hollow body.

2. The board game of claim 1, wherein at least one of the plurality of first team player pieces and at least one of the plurality of second team player pieces includes goalie team piece;

the goalie team piece having a base portion extending from a lateral side surface of the substantially cylindrical hollow body, the base portion adapted to position the goalie team piece in a substantially vertical orientation such that the closed bottom end surface is oriented substantially perpendicular to a playing surface of the substantially rectangular game board.

3. The board game of claim 1, wherein the plurality of first team player pieces and the plurality of second team player pieces further comprise:

an insert received within the substantially cylindrical hollow body.

4. The board game of claim 3, wherein the insert has at least one surface carrying indicia representing a soccer team.

5. The board game of claim 4, wherein the plurality of first team player pieces and the plurality of second team player pieces further comprise:

a transparent insert cover adapted to be received within the substantially cylindrical hollow body above the insert.

6. The board game of claim 5, wherein the game board further comprises a frictional surface.

7. The board game of claim 6, wherein the top surface of the ball piece further comprises an interlocking pattern of hexagonal portions.

8. The board game of claim 6, wherein the game board is substantially rigid.

9. The board game of claim 8, wherein the game board is foldable.

10. A method of board game play, comprising:

providing a game board having a substantially rectangular surface having indicia representing a marking of a soccer field;

providing a player piece having a substantially cylindrical hollow body, a closed bottom end surface disposed to contact the game board surface, and an open top end dimensioned to receive a player's finger within the cylindrical hollow body;

providing a ball piece formed as a spherical section having a substantially flat bottom surface and a curved top surface; and positioning the closed bottom end surface on top of the ball piece, such that at least a portion of the ball piece is disposed between the game board and the closed bottom end surface; and applying downward pressure by the player's finger within the cylindrical hollow body to exert a pressure on the ball piece, to impart a movement of the ball piece.

11. The method of claim 10, further comprising:

positioning the flat bottom surface of the ball piece in contact with the game board.

12. The method of claim 10, further comprising:

positioning the curved top surface of the ball in contact with the game board.

13. The method of claim 10, further comprising:

providing a frictional surface to the substantially rectangular surface.

14. A board game, comprising:

a game board having a substantially rectangular surface having indicia representing a marking of a soccer field;

a plurality of first team player pieces having a first color;

a plurality of second team player pieces having a second color;

the first team player pieces and the second team player pieces formed having a substantially cylindrical hollow body with a closed bottom end surface oriented for contact with the game board surface and an open top end configured to receive a finger tip of a player playing the board game;

a goal net; and a ball piece formed as a spherical section having a substantially flat bottom surface and a curved top surface, wherein a downward pressing force applied within the cylindrical hollow body of the player piece when the ball piece is disposed between the closed bottom end surface and the game board, squeezes the ball piece between the bottom end surface and the game board to impart a movement of the ball piece for play of the board game.

15. The board game of claim 14, wherein at least one of the plurality of first team player pieces and at least one of the plurality of second team player pieces includes goalie team piece;

the goalie team piece having a base portion extending from a lateral side surface of the substantially cylindrical hollow body, the base portion adapted to position the goalie team piece in a substantially vertical orientation such that the closed bottom end surface is oriented substantially perpendicular to a playing surface of the substantially rectangular game board.

16. The board game of claim 14, wherein the plurality of first team player pieces and the plurality of second team player pieces further comprise:

an insert received within the substantially cylindrical hollow body.

17. The board game of claim 16, wherein the insert has at least one surface carrying indicia representing a soccer team.

18. The board game of claim 17, wherein the plurality of first team player pieces and the plurality of second team player pieces further comprise:

a clear insert cover adapted to be received within the substantially cylindrical hollow body to protect the at least one indicia carrying surface of the insert.

19. The board game of claim 14, wherein the top surface of the ball piece further comprises an interlocking pattern of hexagonal portions.

20. The board game of claim 14, wherein the game board is substantially rigid.

* * * * *